United States Patent [19]

Podboronov et al.

[11] 4,190,776

[45] Feb. 26, 1980

[54] MULTIPOINT MEASURING DEVICE

[76] Inventors: Boris P. Podboronov, ulitsa Molodezhnaya, 30, kv. 50, Zhukovsky Moskovskoi oblasti; Sergei S. Sokolov, ulitsa Vavilova, 513, kv. 137, Leningrad; Anatoly V. Furman, ulitsa Chkalova, 21, kv. 6, Zhukovsky Moskovskoi oblasti, all of U.S.S.R.

[21] Appl. No.: 868,630

[22] Filed: Jan. 11, 1978

[30] Foreign Application Priority Data

Jan. 18, 1977 [SU] U.S.S.R. ..... 2443394

[51] Int. Cl.[2] ..... H01H 0/00

[52] U.S. Cl. ..... 307/112; 73/772; 73/340; 364/508; 73/771

[58] Field of Search ..... 307/112, 113, 115; 73/88.5 R, 88.5 SD, 340; 364/508; 335/134; 340/166 R

[56] References Cited

U.S. PATENT DOCUMENTS

| | | | |
|---|---|---|---|
| 3,161,045 | 12/1964 | Ames | 73/88.5 R |
| 3,495,079 | 2/1970 | Halawa | 364/508 |

*Primary Examiner*—L. T. Hix
*Assistant Examiner*—James L. Dwyer
*Attorney, Agent, or Firm*—Steinberg & Blake

[57] ABSTRACT

A multipoint measuring device comprising a matrix of transducers of the measured quantity and switching elements, the columns of said matrix being formed by serially connected switching elements and each transducer having one of its terminals connected to a respective switching element of the column and the other terminal connected to a common bus of a respective row. At the beginning and at the end of each row there are provided switching elements. The matrix is connected to a measuring circuit via two compensators.

1 Claim, 2 Drawing Figures

MULTIPOINT MEASURING DEVICE

FIELD OF THE INVENTION

The present invention relates to electrical measuring apparatus, and more particularly to multipoint measuring devices. It may be used in a variety of industrial applications for multipoint measurements with the aid of transducers, for example, in the form of resistance strain gauges or thermometers, converting the measurand to an electric signal. The invention is particularly useful for production strength tests of units.

BACKGROUND OF THE INVENTION

Multipoint measuring devices with a switch are known in the prior art, in which transducers converting the measurand to an electric signal are connected via transistor switching devices to a measuring circuit. Said switch comprises, in turn, an off-line control unit and binary-decimal registers with decoders (cf. USSR Inventor's Certificate No. 480,190). However, when such measuring devices are employed in construction strength tests, using resistance strain gauges or thermometers, one has to use an objectionably large amount of connecting wires and switching elements.

Thus, connection of a resistance strain gauge or thermometer requires four switching elements and four connecting wires having a length of about several dozen or even hundreds of meters. This involves great difficulties in the case of many times repeated tensometric measurements in complex constructions, wherein a number of transducers of the measured quantity may reach several tens of thousands.

SUMMARY OF THE INVENTION

It is an object of the present invention to provide a multipoint measuring device in which transducers of the quantity being measured are connected in such a configuration that the total number of connecting wires and switching elements is substantially reduced without affecting the high measurement characteristics in the course of sequential placing the transducers via a four-wide connection system in the measuring circuit.

The foregoing and other objects of the invention are attained by that transducers in a multipoint measuring device, which convert the measurand to an electric signal and are associated via switching elements of a switch with a measuring circuit, according to the present invention, are connected to the switching elements to form a matrix wherein columns are formed by serially connected switching elements, and each transducer of the measured quantity has one of its terminals connected to a respective switching element of the column and the other terminal connected to a common bus of a respective row, said bus collecting all the terminals of the transducers associated with said row and having respective switching elements at the beginning and at the end, said matrix being connected to the measuring circuit via two compensators associated, respectively, with the rows and columns so that both rows and columns are connected in parallel with respective compensators, said compensators serving to compensate for resistances of the connecting lines of the transducers and intrinsic resistances of the switching elements.

BRIEF DESCRIPTION OF THE DRAWINGS

The invention will now be described in greater detail with reference to the accompanying drawings, in which.

DETAILED DESCRIPTION OF THE INVENTION

Figure 1:
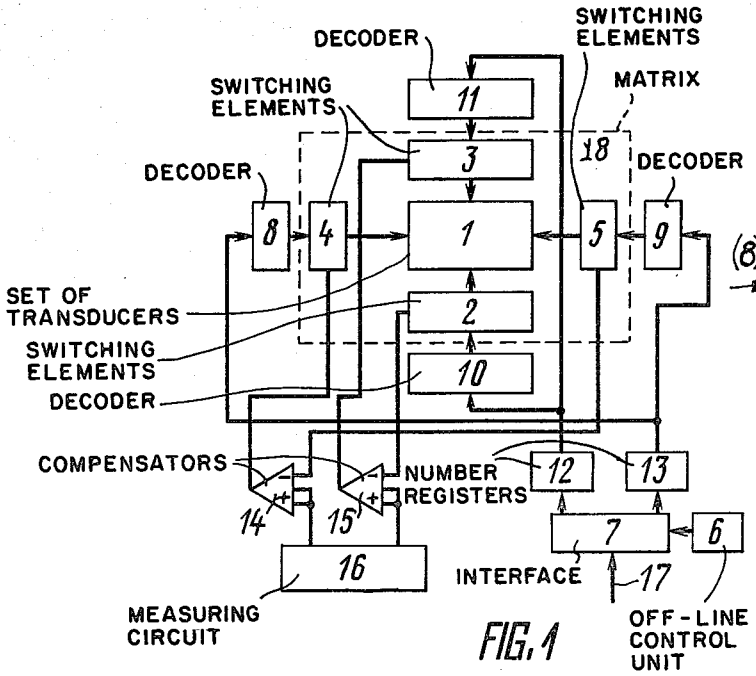
FIG. 1 illustrates a multipoint measuring device according to the present invention.

The multipoint measuring device comprises a matrix which is essentially a set 1 (FIG. 1) of transducers converting the measurand to an electric signal and groups 2,3,4 and 5 of switching elements. The process of measurement is controlled by an off-line control unit 6 associated with an interface 7. The device also includes decoders 8 and 9 of rows and decoders 10 and 11 of columns which are connected to the interface 7 via number registers 12 and 13. Two compensators 14 and 15 for the matrix rows and columns, respectively, are provided in the device to compensate for resistances of the connecting lines of the transducers and intrinsic resistances of the switching elements, said compensators being associated with the matrix and providing for connection of the transducers to a measuring circuit 16. An input 17 of the interface unit 7 is coupled to a computer (not shown) which supplies driving signals. In FIG. 1, the set 1 of transducers and the groups 2, 3, 4 and 5 of switching elements which, as a whole, form the matrix 18, are enclosed by a broken line.

Figure 2:
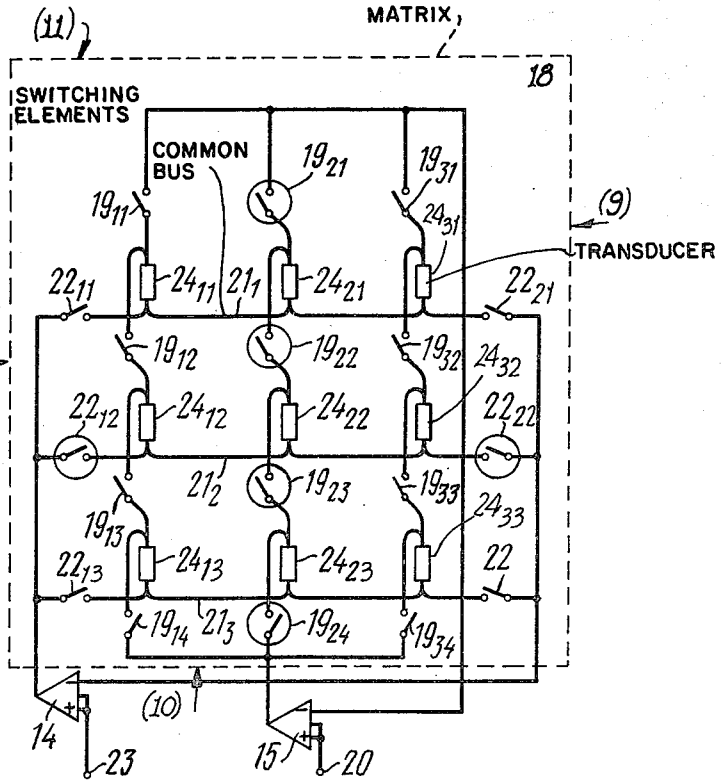
FIG. 2 illustrates a matrix of the multipoint measuring device according to the present invention.

FIG. 2 illustrates the matrix 18 comprising transducers and switching elements. Although the matrix is shown as consisting of three rows and three columns, it should be understood that any number of rows and columns may be used. The columns of the matrix are formed by switching elements $\mathbf{19}_{ij}$, wherein i is a number of a column and j is a number of a row, in the following manner: the first column comprises switching elements $\mathbf{19}_{11}$, $\mathbf{19}_{12}$, $\mathbf{19}_{13}$, $\mathbf{19}_{14}$, the second column comprises switching elements $\mathbf{19}_{21}$, $\mathbf{19}_{22}$, $\mathbf{19}_{23}$, $\mathbf{19}_{24}$, and the third column comprises switching elements $\mathbf{19}_{31}$, $\mathbf{19}_{32}$, $\mathbf{19}_{33}$, $\mathbf{19}_{34}$. All the columns are connected to the column compensator 15 whose output 20 is coupled to the measuring circuit 16 (FIG. 1).

The rows of the matrix are formed by common buses $\mathbf{21}_1$, $\mathbf{21}_2$, $\mathbf{21}_3$, (FIG. 2), each row having switching elements $\mathbf{22}_{1j}$ and $\mathbf{22}_{2j}$ are connected respectively thereto at the beginning and at the end, respectively, and all the rows being connected to the row compensator 14, whose output 23 is connected to the measuring circuit 16 (FIG. 1). Each of the transducers $\mathbf{24}_{ij}$ (FIG. 2) of the measured quantity has one of its terminals connected to two neighboring switching elements of a respective column via two long wires, while the other terminal is connected to a short common bus of a respective row via two short wires. The division of the switching elements $\mathbf{19}_{ij}$ of the matrix 18 into the blocks 2 and 3 is purely arbitrary. The blocks 2 and 3 of the switching elements, shown in FIG. 1, comprise all the columns of the switching elements $\mathbf{19}_{ij}$ of FIG. 2. More particularly, the block 2 comprises the switching elements $\mathbf{19}_{13}$, $\mathbf{19}_{23}$, $\mathbf{19}_{33}$, $\mathbf{19}_{14}$, $\mathbf{19}_{24}$ and $\mathbf{19}_{34}$ and the block 3 comprises the switching elements $\mathbf{19}_{11}$, $\mathbf{19}_{21}$, $\mathbf{19}_{31}$, $\mathbf{19}_{12}$, $\mathbf{19}_{22}$ and $\mathbf{19}_{32}$.

A set of transducers which convert the measurand into an electrical signal, shown in FIG. 1, corresponds to all the transducers $\mathbf{24}_{ij}$ shown in FIG. 2, that is, the transducers $24_{11}$, $24_{21}$, $24_{31}$, $24_{12}$, $24_{22}$, $24_{32}$, $24_{13}$, $24_{23}$ and $24_{33}$.

The multipoint measuring device operates as follows.

A driving signal from the computer or from the off-line control unit 6 is delivered via the interface 7 to the number registers 12 and 13 so that definite binary-coded numbers are entered therein. Then, these numbers are transmitted to the binary-decimal decoders 8 to 11, and a signal produced at their outputs turns on respective switching elements 19 and 22 connecting a transducer 24 selected from the set 1 (FIG. 1) to the inputs of the compensators 14 and 15. FIG. 2 illustrates, by way of example, the transducer $24_{22}$ as being placed in circuit via the switching elements $22_{12}$ and $22_{22}$ of the second row and switching elements $19_{21}$, $19_{22}$, $19_{23}$ and $19_{24}$ of the second column which are closed, which is conventionally shown by circles. In the same manner, any of the transducers 24 may be placed in a row. The proposed circuit arrangement for connection of the transducers 24 to the compensators 14 and 15, such as well known devices with operational amplifiers coupled by a negative feedback to the switching elements 19 and 22, permits eliminating mutual interference between the transducers 24 during measurement and recording of the measurand, as well as compensating for resistances of the connecting lines of the transducers 24 and intrinsic resistances of the switching elements 19 and 22.

As a result, the transducer $24_{22}$ is connected to the input of the measuring circuit 16.

The arrangement providing connection of the transducers 24 and switching elements 19 and 22, as described above, may be implemented in the following manner: the transducers 24 are located on the unit to be tested, while the compensators 14, 15 and the switching elements 19 and 22 are remotely installed in any other place, for instance, at the control desk, but now the total length of communication line between the transducers and the compensators 14 and 15 is by far less than the total length of connections between the transducers and the compensators 14 and 15 in any known design, which is another important advantage of the present invention.

Owing to tight negative feedback couplings with the operational amplifiers, not only errors due to resistances of the transducer connecting lines and due to intrinsic resistances of the switching elements, but also errors due to their variations under environmental conditions are eliminated, thus resulting in highly improved measurement characteristics of the device as a whole. In addition, the reliability of the measuring device is greatly increased.

What is claimed is:

1. A multipoint measuring device, comprising a measuring circuit;

switch means having switching elements;

a plurality of transducers, each converting the measurand to an electric signal and each having two terminals, said transducers forming, in conjunction with said switching elements, a matrix having columns formed by said switching elements connected in series, and rows, each of said rows comprising a common bus, each of said buses having a beginning and a spaced opposite end and having connected thereto one of said switching elements at the beginning and one of said switching elements at the end, each of said transducers having one of the terminals thereof connected to a respective switching element forming the corresponding column of the matrix and the other terminal thereof connected to the common bus of a respective row of said matrix;

a first compensator for the rows of said matrix; and a second compensator for the columns of said matrix, said compensators compensating for the resistances of the connecting lines of said transducers and the intrinsic resistances of said switching elements, said compensators connecting said matrix to said measuring circuit so that both rows and columns of said matrix are connected in parallel with said compensators.

* * * * *